US008167580B2

(12) United States Patent
Stoelzer

(10) Patent No.: US 8,167,580 B2
(45) Date of Patent: May 1, 2012

(54) AXIAL PISTON MACHINE WITH HYDROSTATIC SUPPORT OF THE HOLDING-DOWN DEVICE

(75) Inventor: Rainer Stoelzer, Neu-Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 906 days.

(21) Appl. No.: 12/281,177

(22) PCT Filed: May 18, 2007

(86) PCT No.: PCT/EP2007/004471

§ 371 (c)(1),
(2), (4) Date: Aug. 29, 2008

(87) PCT Pub. No.: WO2007/140868

PCT Pub. Date: Dec. 13, 2007

(65) Prior Publication Data

US 2009/0129949 A1 May 21, 2009

(30) Foreign Application Priority Data

Jun. 2, 2006 (DE) ..... 10 2006 025 989
Sep. 28, 2006 (DE) ..... 10 2006 046 128

(51) Int. Cl.
*F04B 1/12* (2006.01)
*F04B 27/08* (2006.01)

(52) U.S. Cl. ..... 417/269; 91/499

(58) Field of Classification Search ..... 417/269; 91/499

See application file for complete search history.

(56) References Cited

U.S. PATENT DOCUMENTS 4,637,293 A * 1/1987 Yamaguchi et al. ..... 91/507
4,852,463 A * 8/1989 Wagenseil ..... 91/488
5,011,377 A * 4/1991 Sagawa et al. ..... 417/269
5,971,717 A * 10/1999 Berthold ..... 417/269
5,983,781 A * 11/1999 Ivantysyn ..... 92/71
6,244,160 B1 * 6/2001 Kunze ..... 92/57
6,406,271 B1 * 6/2002 Valentin ..... 417/269
6,425,314 B1 * 7/2002 Kleinedler et al. ..... 92/71

(Continued)

FOREIGN PATENT DOCUMENTS

DE 44 23 023 A1 1/1996

(Continued)

OTHER PUBLICATIONS

International Search Report issued in International Application No. PCT/EP2007/004471 dated Oct. 8, 2007.

*Primary Examiner* — Charles Freay
*Assistant Examiner* — Peter J Bertheaud
(74) *Attorney, Agent, or Firm* — Scully, Scott, Murphy & Presser, P.C.

(57) ABSTRACT

An axial piston machine is provided. A housing of the machine receives an eccentric disk and a rotatably mounted cylinder drum. The drum has cylinders and pistons. The pistons are reciprocatable in the cylinders. The ends of the cylinders project from the cylinders and are supported via sliding blocks against a sliding surface on the eccentric disk. The sliding blocks are held in abutment with the sliding surface through a holding-down device. A pressure prevailing in a pressure chamber under the sliding blocks by a throttle point partially compensates a force that is exerted by the holding-down device on the sliding blocks, through a hydraulic pressure between an annular seating surface of the sliding blocks and a support surface of the holding-down device.

11 Claims, 2 Drawing Sheets

U.S. PATENT DOCUMENTS 7,963,209 B2 * 6/2011 Olsen et al. ..... 92/12.2

FOREIGN PATENT DOCUMENTS

DE 196 01 721 A1 7/1997
EP 0 274 251 A1 12/1987
EP 0 300 274 A1 7/1988
GB 913.549 12/1962
GB 2 167 153 A 5/1986

* cited by examiner

AXIAL PISTON MACHINE WITH HYDROSTATIC SUPPORT OF THE HOLDING-DOWN DEVICE

BACKGROUND

The invention relates to an axial piston machine.

For example, from DE 44 23 023 A1 an axial piston machine is known, which has a housing, the housing interior of which comprises a leakage space and receives an eccentric disk as well as a rotatably mounted cylinder drum with cylinders and pistons, which are reciprocable in the cylinders and of which the ends projecting from the cylinders are supported against the eccentric disk.

Furthermore, from DE 196 01 721 A1 a multi-part sliding block of optimized weight is known, which is used for the sliding support of the pistons of an axial or radial piston machine against a sliding surface, which is formed for example on a wobble plate, swash plate or skew plate. The sliding block comprises a support body, which is connected to the associated piston, as well as a sliding part, which lies against the sliding surface. The sliding block is manufactured from materials that allow a weight reduction of the sliding block, thereby decreasing the centrifugal forces acting upon the sliding block. This allows the axial piston machine to be operated at an increased rotational speed.

The known axial piston machines have the drawback that the sliding blocks, independently of their selected shape, are applied with a mechanical bias substantially by a common pressure plate. The point of contact of the two parts, even when good sliding partners and surface qualities are selected, is subject to mechanical friction, especially as the supporting surface from a design viewpoint should be kept as small as possible, with the result that the surface pressure is very high.

SUMMARY

One aspect of the present invention is therefore to develop an axial piston machine of the initially described type in such a way that in all operating states of the axial piston machine adequate lubrication is available for the radial movement of the sliding blocks.

According to one aspect of the invention, it is therefore provided that between the sliding blocks and the sliding disk a permanent lubricating film is formed, which arises in that a pressure prevailing in a pressure chamber under the sliding blocks partially compensates by means of a connection throttle a pressure that is exerted on the sliding blocks by the holding-down device.

BRIEF DESCRIPTION OF THE DRAWINGS

A preferred embodiment of the invention is described in detail below with reference to the drawings. The drawings show.

DETAILED DESCRIPTION OF EXEMPLARY EMBODIMENTS

Figure 1:
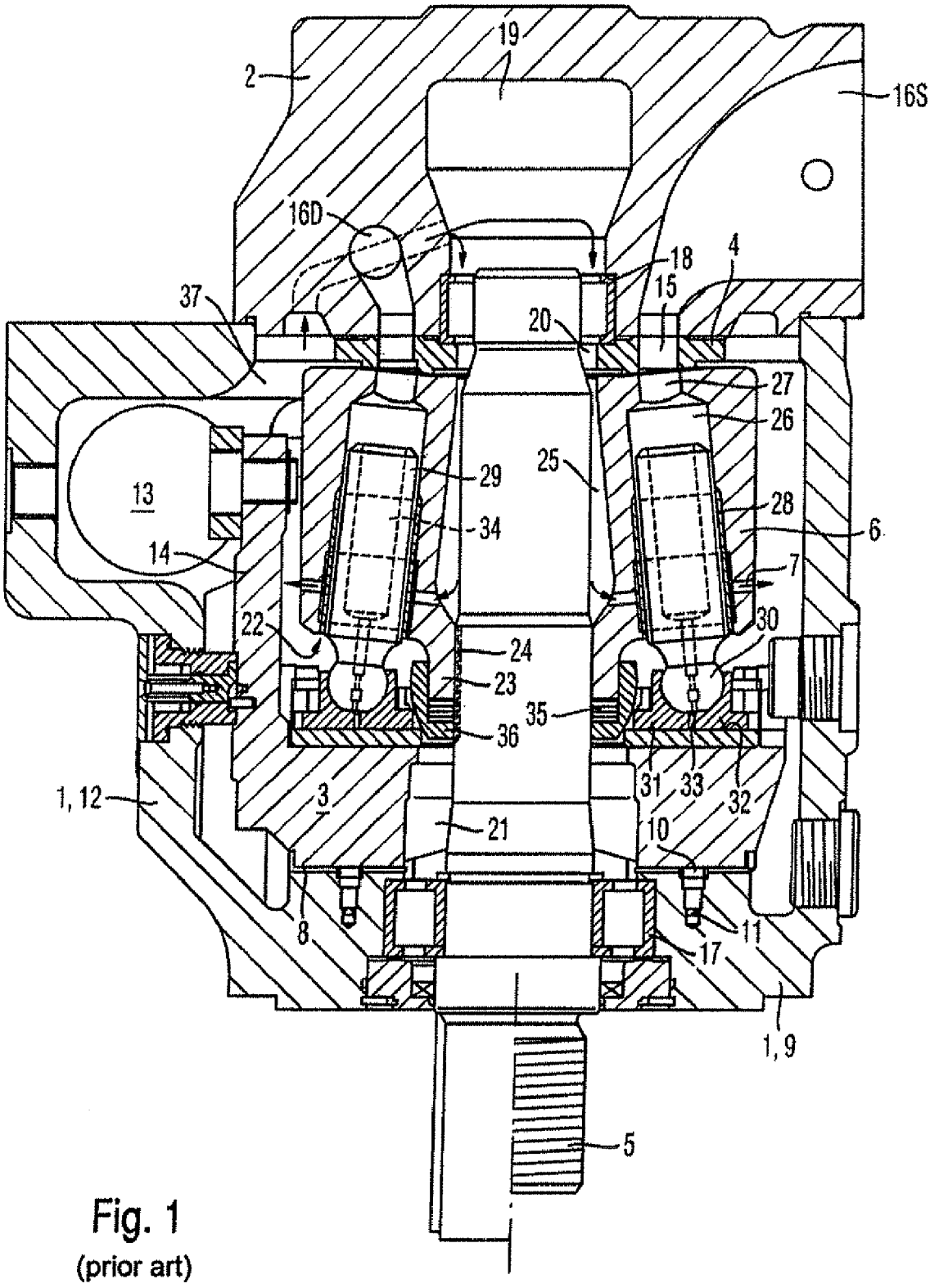
Fig. 1 (prior art)
FIG. 1 an embodiment of an axial piston machine according to prior art.

For a better understanding of the measures according to the invention, FIG. 1 first shows in a sectional view a swash-plate-style axial piston machine with variable displacement volumes and a flow direction according to prior art. The axial piston machine in a known manner comprises as essential components a hollow-cylindrical housing 1 with an open front end, which in FIG. 1 is at the top, a hydraulic block 2 fastened to the housing 1 and closing the open end thereof, an eccentric disk or swash plate 3, a control body 4, a driving shaft 5, a cylinder drum 6. In this embodiment an optional cooling circuit 7 is further provided.

The swash plate 3 is designed as a so-called swing cradle having a semicylindrical cross section and is supported by two bearing surfaces, which extend with mutual spacing parallel to the swing direction, with simultaneous hydrostatic relief against two correspondingly shaped bearing shells 8, which are fastened to the inner surface of the housing end wall 9 lying opposite the hydraulic block 2. The hydrostatic relief is effected in a known manner by means of pressure pockets 10, which are formed in the bearing shells 8 and supplied with pressure medium through ports 11. An adjusting device 13 housed in a bulge of the cylindrical housing wall 12 acts via an arm 14 extending in the direction of the hydraulic block 2 on the swash plate 3 and is used to swing the swash plate 3 about a swivelling axis perpendicular to the swing direction.

The control body 4 is fastened to the inner surface of the hydraulic block 2 facing the housing interior and is provided with two through-openings 15 in the form of kidney-shaped control slots, which are connected by a discharge channel 16D and/or suction channel 16S in the hydraulic block 2 to a non-illustrated discharge- and suction line. The discharge channel 16D has a smaller flow cross section than the suction channel 16S. The spherically designed control surface of the control body 4 facing the housing interior serves as a bearing surface for the cylinder drum 6.

The driving shaft 5 projects through a through-bore in the housing end wall 9 into the housing 1 and is rotatably mounted by means of a bearing 17 in this through-bore as well as by means of a further bearing 18 in a narrower bore portion of a blind hole 19, which is widened at the end, in the hydraulic block 2 and in a region of a central through-bore 20 in the control body 4 that adjoins this narrower bore portion. The driving shaft 5 in the interior of the housing 1 further penetrates a central through-bore 21 in the swash plate 3, the diameter of which is dimensioned in accordance with the maximum swing excursion of the swash plate or eccentric disk 3, as well as a central through-bore in the cylinder drum 6 that comprises two bore portions.

One of these bore portions is formed in a sleeve-shaped extension 23, which is formed on the cylinder drum 6 and projects beyond the end face 22 of the cylinder drum 6 facing the swash plate 3 and by which the cylinder drum 6 is connected by means of a keyed connection 24 in a rotationally fixed manner to the driving shaft 5. The remaining bore portion is designed with a conical shape. It tapers from its cross section of maximum diameter close to the first bore portion to its cross section of minimum diameter close to the end face or bearing surface of the cylinder drum 6 that abuts the control body 4. The annular space defined by the driving shaft 5 and this conical bore portion is denoted by the reference character 25.

The cylinder drum 6 has generally axially extending, stepped cylinder bores 26, which are arranged uniformly on a graduated circle coaxial with the driving shaft axis and open out at the cylinder drum end 22 directly and at the cylinder-drum bearing surface facing the control body 4 via outlet channels 27 on the same graduated circle as the control slots. Inserted into each of the larger-diameter cylinder bore portions that open out directly at the cylinder drum end 22 is a bush 28. The cylinder bores 26 including the bushes 28 are referred to here as cylinders. Pistons 29 disposed displaceably inside these cylinders 26, 28 are provided at their ends facing the swash plate or eccentric disk 3 with ball heads 30, which are mounted in sliding blocks 31 and by means of these sliding blocks 31 are mounted hydrostatically on a sliding surface 32 of the swash plate or eccentric disk 3. Each sliding block 31 on its sliding surface facing the eccentric disk 3 is provided with a pressure pocket (not shown in FIG. 1), which is connected by a through-bore 33 in the sliding block 31 to a stepped axial through-channel 34 in the piston 29 and in this way is connected to the working chamber of the cylinder that is delimited by the piston 29 in the cylinder bore 26. In each axial through-channel 34 a throttle is formed in the region of the associated ball head 30. A holding-down device 36, which is disposed by means of the keyed connection 24 in an axially displaceable manner on the driving shaft 5 and loaded in the direction of the swash plate 3 by means of a spring 35, holds the sliding blocks 31 in abutment with the eccentric disk 3.

The function of the axial piston machine described above is generally known and in the following description of use as a pump is limited to the essentials.

The axial piston machine is intended for operation with oil as a fluid. By means of the driving shaft 5 the cylinder drum 6 together with the pistons 29 is set in rotation. When as a result of actuation of the adjusting device 13 the swash plate 3 is swung into an inclined position relative to the cylinder drum 6, all of the pistons 29 execute reciprocating motions. In the course of rotation of the cylinder drum 6 through 360° , each piston 29 completes an induction stroke and a compression stroke, thereby generating corresponding oil flows, which are fed and removed through the outlet channels 27, the control slots 15 and the discharge— and suction channel 16D and 16S. In this case, during the compression stroke of each piston 29 pressure oil runs from the relevant cylinder 26, 28 through the axial through-channel 34 and the through-bore 33 in the associated sliding block 31 into the pressure pocket thereof and builds up a pressure field between the sliding surface 32 and the respective sliding block 31 that serves as a hydrostatic bearing for the latter. Pressure oil is further supplied through the ports 11 to the pressure pockets in the bearing shells 8 for the hydrostatic support of the swash plate 3.

As already mentioned, such known axial piston machines have the drawback that the sliding blocks 31, independently of whether they are spherical or dome-shaped sliding blocks 31, are pressed with a mechanical bias against the sliding surface 32 of the swash plate 3 substantially by the holding-down device 36 loaded by the spring 35. The point of contact of the two parts, even if good sliding partners and surface qualities are selected, is subject to mechanical friction, especially as the support surface from a design viewpoint should be kept as small as possible, with the result that the surface pressure is very high. This may result in damage and, in turn, to a high susceptibility to faults and costly repairs of the axial piston machine. In order to prevent this, in every operating state of the axial piston machine it has to be ensured that at the points of support of the sliding blocks 31 against the sliding surface 32 adequate lubrication is available for the radial movement of the sliding blocks 31.

Figure 2:
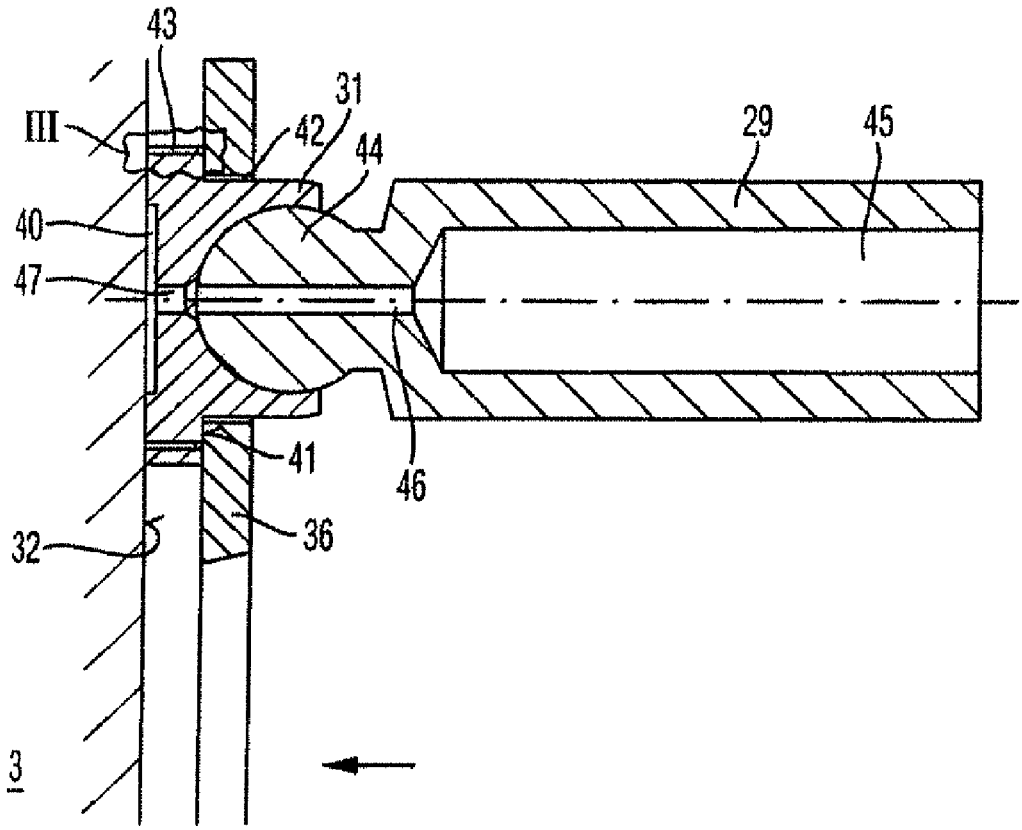
FIG. 2 a detail view of a piston with sliding block from an embodiment of an axial piston machine designed in accordance with the invention, and FIG. 3 a detail from FIG. 2 in the region denoted by III in FIG. 2.

According to one aspect of the invention and as is evident from the detail represented in FIG. 2 in the region of a sliding block 31 and of the associated piston 29, this is made possible in that from a pressure chamber 40 situated under the sliding block 31 in the region of a relief surface 41 of the sliding block 31 at least one connection throttle 43 is formed to a support surface on the holding-down device 36. By virtue of lubricant passing into the support surface a pressure may be built up, which, in relation to the bias of the spring 35 that is exerted via the holding-down device 36 on the sliding block 31, is so dimensioned that it compensates some of the pressure exerted by the holding-down device 36, thereby making it possible to build up and maintain a permanent lubricating film, which partially also penetrates into the annular groove 42.

The piston 29 in the embodiment is of a hollow-cylindrical design with a recess 45. The piston 29 has an integrally moulded ball head 44, which engages into the sliding block 31. The recess 45 is connected by a bore 46 in the ball head 44 that continues as a bore 47 in the sliding block 31 to the pressure chamber 40. For this situation, it is therefore possible to use the throttled high pressure of the lubricant that is applied via the recess 45 of the piston 29 and the bores 46, 47 to the pressure chamber 40. The spring 35 that loads the holding-down device 36 is not further represented in FIG. 2. The introduction of force is however indicated by the arrow.

Figure 3:
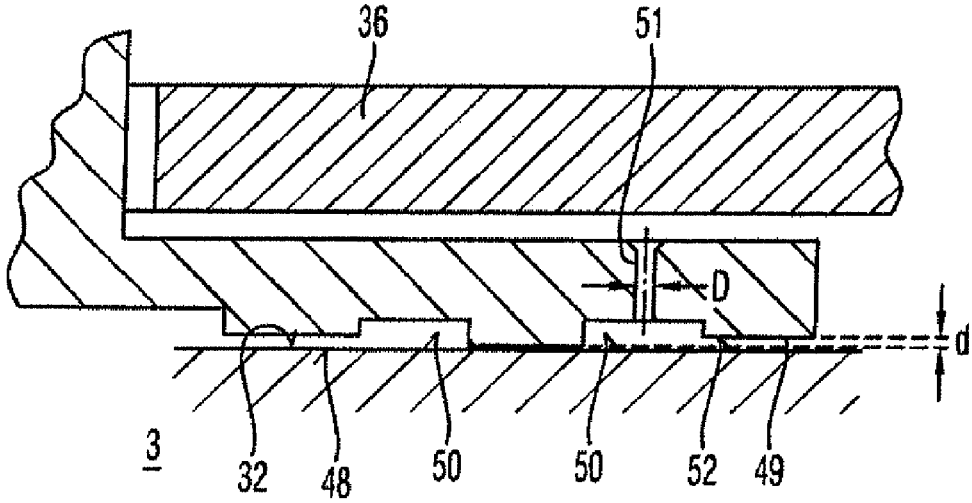

In FIG. 3 a detail from the sliding block 31 is represented in a highly diagrammatic manner.

Given a design of the running surface 52 of the sliding blocks 31 in the form of a labyrinth 50 comprising sealing webs 48 and support webs 49 as represented in FIG. 3, the tapping of the pressure for the build-up of the lubricating film may be removed at a suitable throttled point. For this purpose at least one bore 51 is provided, which has a diameter D, which in relation to a gap dimension d between a support web 49 and the sliding surface 32 is so dimensioned that by means of a suitable selection of the ratio D/d the pressure acting upon the holding-down device 36 is adjustable.

The axial piston machine designed in accordance with the invention is therefore notable for a hydrostatic relief of the seating surfaces of the sliding blocks 31 on the holding-down device 36 that leads above all to lower manufacturing costs of the sliding partners because the sliding blocks 31 and the holding-down device 36 owing to the relief may be manufactured from materials that no longer have to be optimized in terms of the sliding properties. This leads also to advantages in terms of the manufacture and/or strength of the sliding partners.

As a result of the relief, higher biases of the holding-down device 36 may be transferred without friction losses to the sliding blocks 31, thereby improving the operational reliability of the axial piston machine. The wear between the sliding blocks 31 and the holding-down device 36 may therefore likewise be reduced.

Furthermore, owing to the formation of a lubricating film in all operating states of the axial piston machine, a damped abutment of the components together with the reduction of the transmission of structure-borne noise is possible.

The invention is not limited to the illustrated embodiments but is also suitable for use in further designs of axial piston machines. All of the features of the invention may be combined in any desired manner with one another.

The invention claimed is:

1. An axial piston machine, comprising:

a housing, which receives an eccentric disk and a rotatably mounted cylinder drum with cylinders and pistons, the pistons being reciprocatable in the cylinders, the ends of the pistons projecting from the cylinders being supported via sliding blocks against a sliding surface on the eccentric disk, and a holding-down device, by which the sliding blocks are held in abutment with the sliding surface, wherein a pressure prevailing in a pressure chamber creates a pressing force under the sliding blocks, adjacent a throttling point, and partially compensates for a force that is exerted by the holding-down device on the sliding blocks through a hydraulic pressure between an annular seating surface of the sliding blocks and a support surface of the holding-down device, wherein the throttling point comprises a connection throttle in the sliding blocks, the connection throttle being connected to a groove between the holding-down device and the sliding blocks, and wherein the annular seating surface is provided between the connection throttle and the groove on the sliding blocks.

2. The axial piston machine according to claim 1, wherein the holding-down device lies against the annular seating surface.

3. The axial piston machine according to claim 1 wherein the pressing force counteracting the force exerted by the holding-down device is adjustable by means of the diameter of the connection throttle.

4. The axial piston machine according to claim 1, wherein a running surface of the sliding blocks that lies opposite the sliding surface of the eccentric disk has a labyrinth.

5. The axial piston machine according to claim 4, wherein the labyrinth comprises sealing webs that lie in sealing abutment with the eccentric disk.

6. The axial piston machine according to claim 4, wherein the labyrinth comprises support webs that are spaced apart from the eccentric disk by a distance (d).

7. The axial piston machine according to claim 6, wherein the connection throttle comprises at least one bore opening into the labyrinth adjacent to at least one of the support webs.

8. The axial piston machine according to claim 7, wherein the at least one bore has a diameter (D).

9. The axial piston machine according to claim 8, wherein the pressing force counteracting the force exerted by the holding-down device is adjustable by means of the ratio (D/d) of the diameter (D) of the bore to the distance (d) of the support webs from the eccentric disk.

10. The axial piston machine according to claim 1, wherein, through recesses of the piston and bores in ball heads of the pistons and in the associated sliding blocks, the pressure chambers are loadable with operating pressure.

11. The axial piston machine according to claim 1, wherein a permanent lubricating film is formed between the sliding blocks and the sliding surface, and between the sliding blocks and the holding-down device.

* * * * *